US005360143A

United States Patent [19]

Stultz

[11] Patent Number: 5,360,143

[45] Date of Patent: Nov. 1, 1994

[54] LINED HOPPER FOR STORING SOLIDS

[75] Inventor: Jeffrey H. Stultz, Freeport, Tex.

[73] Assignee: The Dow Chemical Company, Midland, Mich.

[21] Appl. No.: 55,155

[22] Filed: Apr. 29, 1993

[51] Int. Cl.[5] ..... B65D 35/22

[52] U.S. Cl. ..... 222/94; 222/105; 220/4.17; 220/691; 220/692

[58] Field of Search ..... 222/94, 95, 105, 386.5; 220/4.17, 461, 691, 692

[56] References Cited

U.S. PATENT DOCUMENTS

| | | | |
|---|---|---|---|
| Re. 32,232 | 8/1986 | Bonerb et al. | 222/105 X |
| 2,912,136 | 11/1959 | Redmond et al. . | |
| 2,953,276 | 9/1960 | Dunn | 220/4.17 |
| 2,967,699 | 1/1961 | Brown . | |
| 2,970,042 | 1/1961 | Lagerwey . | |
| 3,199,726 | 8/1965 | Pierson | 222/105 X |
| 3,355,080 | 11/1967 | Rausing et al. . | |
| 3,777,938 | 12/1973 | Nikowitz et al. | 222/105 X |
| 4,079,851 | 3/1978 | Valyi | 215/1 |
| 4,625,892 | 12/1986 | Carlin, Jr. | 220/465 |
| 4,946,071 | 8/1990 | Poulton | 222/105 |

*Primary Examiner*—Gregory L. Huson

[57] ABSTRACT

A hopper for solids is disclosed which, in one aspect, has a main hollow body for storing the solids, an inlet for feeding solids into the main hollow body, a discharge section for discharging the solids from the main hollow body, and a plastic liner device loosely covering interior surfaces of the hopper. In one aspect the plastic liner device includes sub-parts, each sub-part secured to a sub-part of the main hollow body and/or to the inlet or discharge sections. In one aspect separate sealed compartments facilitating leak detection are formed between each liner sub-part and the wall of the main hollow body. Also disclosed is a hopper that provides both primary (liner) and secondary (hopper wall) containment.

16 Claims, 2 Drawing Sheets

LINED HOPPER FOR STORING SOLIDS

BACKGROUND OF THE INVENTION

1. Field Of The Invention

This invention is related to lined hoppers and vessels and, in one aspect, to a carbon steel vessel with a loose plastic liner.

2. Description Of Related Art

Prior art hoppers or vessels for containing solids are subject to corrosion and erosion due to moisture in the solids and to the chemical nature of the solids. Some solids "bridge" across an outlet, impeding or preventing flow therefrom. Leakage of vapors, liquids, or solids and leak location are also a problem with certain prior art hoppers.

There has long been a need for an effective hopper liner. There has long been a need for a hopper for containing solids in which leakage is inhibited or prevented. There has long been a need for a hopper in which corrosion and erosion are inhibited. There has long been a need for an effective leak detection system for such hoppers. There has long been a need for a solution to the problem of bridging solids in hoppers.

SUMMARY OF THE PRESENT INVENTION

In one embodiment of the present invention, a loose plastic liner is installed into a carbon steel vessel or hopper for containing solids. The liner is held in place with hopper body flanges and seal welded to prevent corrosion and erosion of the vessel. In one embodiment the hopper has a bottom discharge cone and the liner extends to protect this cone. The loose liner assists in the elimination of bridging of solids stored in the hopper since it provides a low coefficient of friction and a non-static surface; and thus reduces, therefore, problems common to removing high angle of repose, sticky solids from the hopper. The liner further acts to inhibit leakage of vapors, liquids, or solids from the hopper-acting as a primary containment system. A high density polyethylene liner is used in one preferred embodiment. Preferably this liner ranges between 10 mils and 250 mils thick, with 60 mils most preferred. Such a liner protects a vessel's vertical walls and bottom cone. The liner in one embodiment includes sub-liners which are seal welded and lap body flanges of the vessel at the roof to sidewall, intermediate sidewall, sidewall to bottom cone and cone bottom to live bottom conveyor. The use of the liner reduces the required size of a live bottom solids removal and metering device, reducing capital and energy requirements and simplifying mechanical design. A "loose" liner is not adhered to the vessel's interior at every point, but is secured to the hopper only at certain points, e.g. at bolted joints and/or at selected other points. Seal welding is done by, e.g., heat fusion. This looseness results in an inexpensive, slick, slightly movable sidewall. The body flanges may be softened using appropriate gasketing material, e.g. two layers of thirty pound roofing felt, rubber, or soft gasket material to reduce damage to the liners and promotes sealing. The liners may be made from any suitable material, e.g. but not limited to Teflon (TM) material, Kynar (TM) material, polyethylene, or polypropylene, and can be of varying thickness. Air couplings at each hopper sub-part provide a means to inject air under pressure to move the liner to inhibit bridging or caking thereon, and a means to monitor pressure in the liner-wall compartments to detect leakage.

It is, therefore, an object of at least certain preferred embodiments of the present invention to provide:

New, useful, unique, efficient, non-obvious and effective hoppers for solids;

Such hoppers with a loose plastic liner;

Such hoppers with a loose plastic liner that protects interior hopper surfaces and interior surfaces of a hopper discharge device;

Such hoppers in which leakage of vapors, liquids, and solids is inhibited or prevented; and is easily detected; and Such hoppers in which a liner provides a containment member;

Such liners which make possible an inexpensive retrofit of existing hoppers;

Such hoppers in which looseness of the liner and/or its slickness inhibit the bridging of solids in the hopper.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or addition of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

DESCRIPTION OF EMBODIMENTS PREFERRED AT THE TIME OF FILING FOR THIS PATENT

Figure 1:
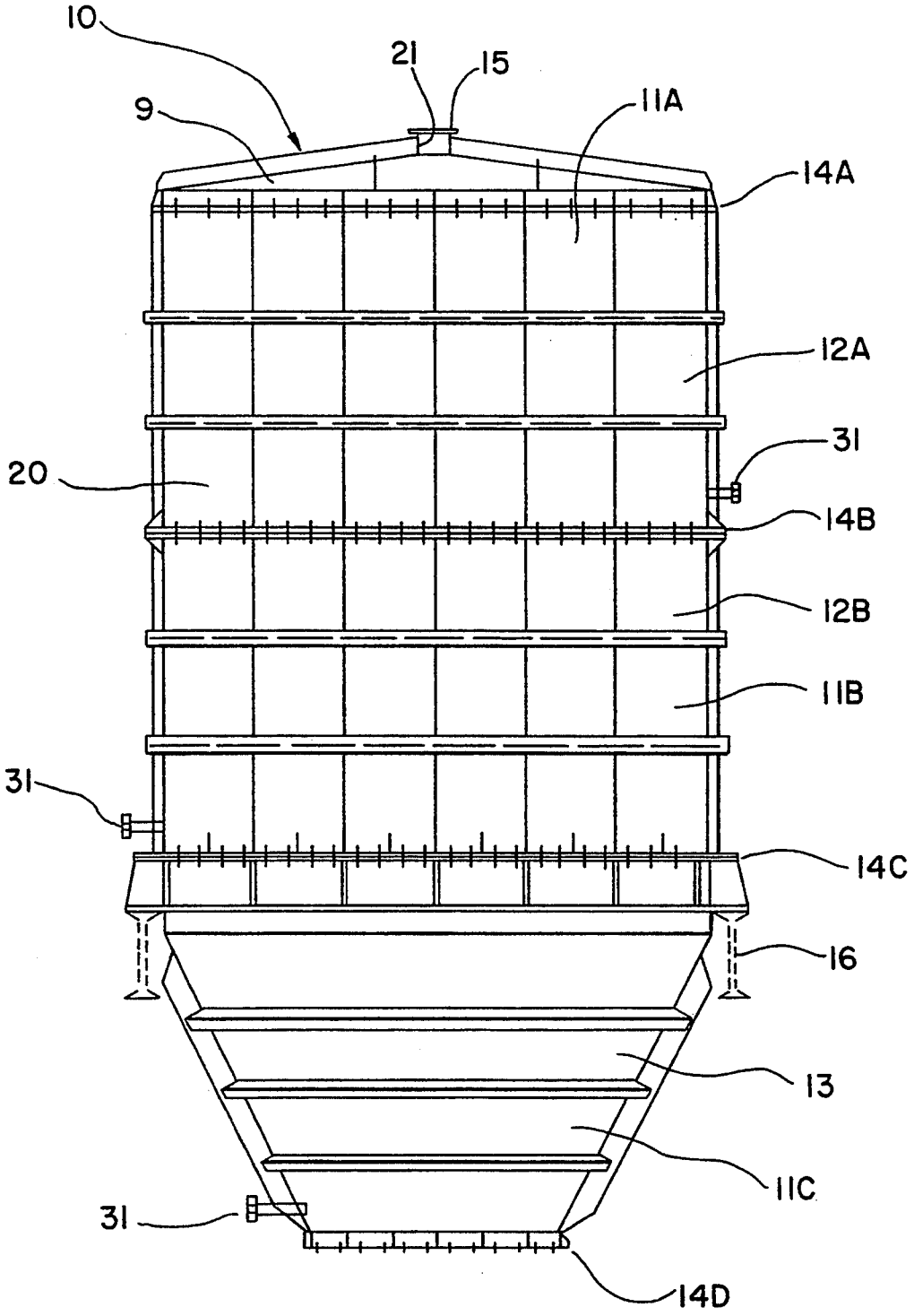
FIG. 1 is a side view of a hopper according to the present invention.
Figure 2:
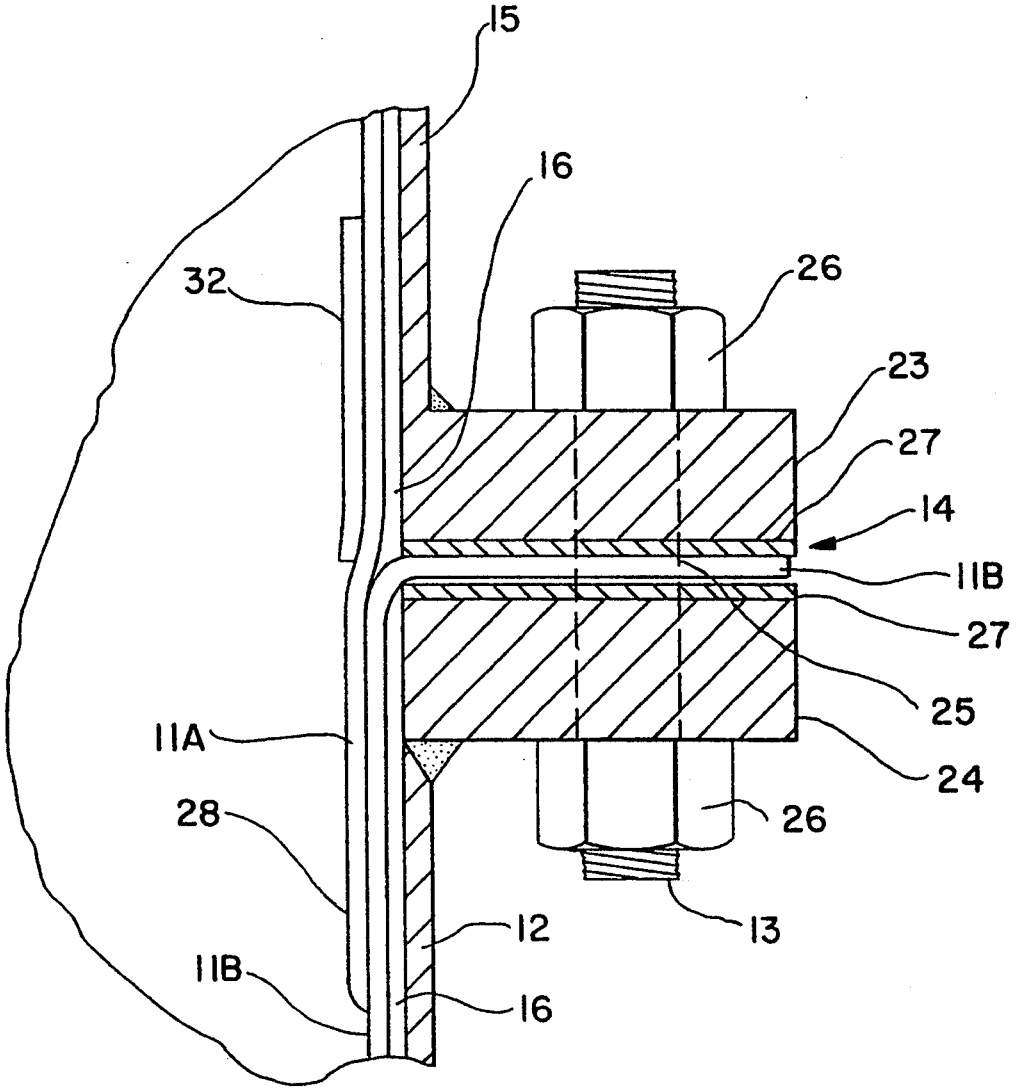
FIG. 2 is a side view in cross-section of the liner securement of the hopper of FIG. 1.

Referring now to FIGS. 1 and 2, a hopper 10 according to the present invention is made from carbon steel and has a main body 20 comprised of sections 12 which are bolted together. A roof 9 is bolted to the top body sections 12. A discharge section 13 is bolted at the bottom of the bottom body sections 12. Preferably the roof 9 is painted on the inside with epoxy paint. Preferably the hopper's interior is coated with a primer coat. Solids to be stored in the hopper 10 are introduced to its interior through a top inlet nozzle 15 which is lined with a plastic liner 21 (e.g. made from 125 mil thick fiber reinforced plastic). The hopper 10 as shown is supported by two steel beams 16. A plastic liner 11*b* is secured in place by a bolted joint 14*b* which joins together the liner, a flange 23 of body section 12*a*, and a flange 24 of the body section 12*b*. A portion of the liner 11*b* is disposed between the two flanges and a bolt 13 passes through a hole 25 in the liner 11 and secures the two flanges together. Nuts 26 hold the bolt tightly in place. As the liner 11*a* overlaps the liner 11*b*, the liner 11*b* overlaps another liner 11*c* which is secured at a bolted joint 14*c* as the liner 11*b* is secured at the bolted joint 14*b*. A third liner 11*c* is overlapped by the liner 11*b*. The liner 11*c* is secured at a bolted joint 14*c* as the liner 11*b* is secured at the bolted joint 14*b* and the liner 11*a* is secured at a bolted joint 14*a*. The liner 11*b* (and similarly the other liners 11*a* and 11*c*) is cushioned between gasket material pieces 27 between the body flanges 23, 24. An overlapping liner end is, preferably, seal welded to the liner it overlaps. For example, as shown in FIG. 2 an end 28 of the liner 11*a* is seal welded with heat fusion to the underlying liner 11*b*. Similarly an end (not shown) of the liner 11*b* is seal welded to the underlying liner 11*c*. A bottom end of the liner 11*c* is secured at a bolted joint 14*d*, which is like the bolted joint 14*a*.

In one embodiment of a hopper 10 the hopper has sides which are eighteen feet wide forming a square cross-section when viewed from above and the discharge section, which is an eighteen foot square at its top, has an eight foot square bottom. This particular hopper is about thirty five feet in height from the top of the hopper to the bottom of the discharge section and the body sections are each about ten and a half feet high (by eighteen feet wide). In one embodiment the liners 11*a*, 11*b*, and 11*c* extend around the square interior of the hopper and are slick, smooth 60 mil thick high density polyethylene. The hopper in one embodiment stores salty, corrosive, sticky, abrasive solids from the filter presses of a wastewater treatment plant and include primary sludge solids and digested secondary sludge solids. In one aspect additional sections of liner, e.g. high density polyethylene piece 32 between one fourth and three fourths inches thick, may be used in place of or seal welded to the initial liner, either over the entire initial liner surface or over selected areas thereof.

When the upper liner portions are seal welded to underlying liner portions this effectively results in a plurality of sealed sub-compartments between bolted joints. Thus a leak in one body section can only flow down to the bolted joint below the leak (or just slightly below the bolted joint). This facilitates leak detection and location. Air couplings 31 at each hopper sub-part provide an air inlet to inject air under pressure into the space between a liner portion and its corresponding wall portion(an inner compartment) to shake loose solids and inhibit their bridging or caking on the liner. These air couplings may also be used to monitor pressure in the compartments to assist in leak detection. A hole in either the liner or the hopper wall will result in a pressure change.

Filed on even date herewith are the following applications, co-owned with this application, whose subject matter is hereby disclosed herein and which may be employed with the present invention in a material treatment system (invention titles followed by applicant(s) name):

"Sludge Digestion;" U.S. Ser. No. 08/055,159; J. Stultz, D. Bice; "Sludge Ammonia Removal;" U.S. Ser. No. 08/055,158; J. Stultz, D. Bice; "Sludge Deodorization;" U.S. Ser. No. 08/055,157; J. Stultz, D. Bice; "Tank Foundation;" U.S. Ser. No. 08/055,152; J. Stultz; "Pipe To Concrete Transition;" U.S. Ser. No. 08/055,153; J. Stultz; "Slab Joint Liquid Stop;" U.S. Ser. No. 08/055,156; J. Stultz; "Sludge Clarifier Bottom;" U.S. Ser. No. 08/055,161; J. Stultz, H. Rabren; "Sludge Clarifier Roof;" U.S. Ser. No. 08/055,154; J. Stultz; "Waste Gas Incineration;" U.S. Ser. No. 08/055,160; J. Stultz, D. Bice In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A hopper for storing solids, the hopper comprising a main body for containing the solids, the main body having an interior surface, an inlet for introducing solids into the main body, the inlet having an interior surface, a discharge section in communication with the main body for discharging solids from the hopper, the discharge section having an interior surface, a plastic liner means secured to the main body and loosely covering the interior surface of the main body, the plastic liner means loosely covering the interior surface of the discharge section, a part of the plastic liner means secured to the discharge section, the main body comprised of body sub-sections, each body sub-section having flanges extending therefrom with bolt holes therethrough, the sub-sections bolted together with bolts extending through the bolt holes, the plastic liner means comprising a plurality of sub-liners, one sub-liner corresponding to and attached at each body sub-section, and a lower sub-liner overlapped by a portion of corresponding upper sub-liner, the sub-liners held between the flanges of the body sub-sections, an overlapping end of an upper sub-liner secured to a portion of its corresponding underlying sub-liner, and a sealed compartment is formed beneath each sub-liner.

2. A hopper for storing solids, the hopper comprising a main body for containing the solids, the main body made of carbon steel and having an interior surface, an inlet for introducing solids into the main body, the inlet having an interior surface, a discharge section in communication with the main body for discharging solids from the hopper, the discharge section having an interior surface, a plastic liner means comprising a plurality of sub-liners including at least a first sub-liner and a second sub-liner, the first sub-liner overlapping the second sub-liner, the plastic liner means secured to the main body and loosely covering the interior surface of the main body.

3. The hopper of claim 2 comprising also the plastic liner means loosely covering the interior surface of the discharge section, a part of the plastic liner means secured to the discharge section.

4. The hopper of claim 2 wherein an end of the first sub-liner is secured to a portion of the second sub-liner.

5. The hopper of claim 2 wherein the plastic liner means is secured to the main body by holding a portion of the plastic liner means between flanges of portions of the main body member.

6. The hopper of claim 5 wherein gasket material is disposed on either side of the plastic liner means to cushion it between the flanges.

7. The hopper of claim 2 wherein the main body is comprised of body sub-sections, each body sub-section having flanges extending therefrom with bolt holes therethrough, the sub-sections bolted together with bolts extending through the bolt holes.

8. The hopper of claim 7 wherein the plastic liner means comprises a plurality of sub-liners, one sub-liner corresponding to and attached at each body sub-section, and a lower sub-liner overlapped by a portion of a corresponding upper sub-liner, the sub-liners held between the flanges of the body sub-sections.

9. The hopper of claim 8 wherein gasket material is disposed on either side of each sub-liner to cushion it between the flanges.

10. The hopper of claim 8 wherein an overlapping end of an upper sub-liner is secured to a portion of its corresponding underlying sub-liner.

11. The hopper of claim 2 wherein the discharge section is reduced in cross-section from top to bottom.

12. The hopper of claim 2 comprising also an additional liner seal welded over the plastic liner means.

13. The hopper of claim 2 wherein the additional liner is thicker than the plastic liner means.

14. The hopper of claim 2 wherein the additional liner covers the entire surface of the plastic liner means.

15. The hopper of claim 4 wherein a sealed first sub-compartment is formed beneath the first sub-liner.

16. The hopper of claim 15 wherein there is a plurality of sub-liners and a sealed compartment is formed beneath each overlapping sub-liner.

* * * * *